US012420155B2

(12) United States Patent
Flores

(10) Patent No.: US 12,420,155 B2
(45) Date of Patent: Sep. 23, 2025

(54) PORTABLE BEER PONG DEVICE

(71) Applicant: Gilberto Flores, Parlier, CA (US)

(72) Inventor: Gilberto Flores, Parlier, CA (US)

( * ) Notice: Subject to any disclaimer, the term of this patent is extended or adjusted under 35 U.S.C. 154(b) by 628 days.

(21) Appl. No.: 17/890,062

(22) Filed: Aug. 17, 2022

(65) Prior Publication Data

US 2024/0058671 A1 Feb. 22, 2024

(51) Int. Cl.

| | |
|---|---|
| ***A63B 63/08*** | (2006.01) |
| ***A47B 3/06*** | (2006.01) |
| ***A47B 13/08*** | (2006.01) |
| ***A47B 13/16*** | (2006.01) |
| ***A47B 25/00*** | (2006.01) |
| ***A63B 67/00*** | (2006.01) |
| ***A63B 67/06*** | (2006.01) |

(52) U.S. Cl.

CPC ..... *A63B 63/08* (2013.01); *A47B 3/06* (2013.01); *A47B 13/088* (2013.01); *A47B 13/16* (2013.01); *A47B 25/00* (2013.01); *A63B 67/002* (2013.01); *A63B 67/06* (2013.01); *A63B 2210/50* (2013.01); *A63B 2225/682* (2013.01)

(58) Field of Classification Search

None

See application file for complete search history.

(56) References Cited

U.S. PATENT DOCUMENTS

| | | | | |
|---|---|---|---|---|
| 8,028,995 | B2 * | 10/2011 | Hoffer | A63B 67/06 273/342 |
| 8,146,921 | B2 * | 4/2012 | Lombardi | A63B 67/04 273/342 |
| 8,662,501 | B1 | 3/2014 | Perales | |
| 9,199,149 | B2 | 12/2015 | Max | |
| 9,643,067 | B2 | 5/2017 | Snyder | |
| 10,265,596 | B2 * | 4/2019 | Skala | A63B 1/00 |
| 10,525,319 | B1 | 1/2020 | Sabo | |
| 11,524,217 | B2 * | 12/2022 | Smith | A63B 67/002 |
| 2012/0202623 | A1 | 8/2012 | Bowden | |
| 2014/0027983 | A1 | 1/2014 | Keebler | |
| 2014/0265136 | A1 * | 9/2014 | Parker | A63B 63/00 273/398 |
| 2020/0047060 | A1 | 2/2020 | Bauer | |

FOREIGN PATENT DOCUMENTS

| | | |
|---|---|---|
| WO | WO2011105983 | 9/2011 |

* cited by examiner

*Primary Examiner* — Jason T Yen

(57) ABSTRACT

A portable beer pong device for portably providing a unique setup configuration for the cups in beer pong includes a table with a tabletop and a detachable leg. A connecting panel is pivotably coupled to a front end of the tabletop, and a cup holding panel is pivotably coupled to the connecting panel opposite the tabletop. A support member is coupled to the cup holding panel opposite the connecting panel for supporting the cup holding panel in an angled position relative to a support surface. A plurality of main cup slots extends through the tabletop for receiving therethrough and holding a corresponding one of a plurality of cups. And a plurality of secondary cup slots extends through the cup holding panel for the same.

12 Claims, 6 Drawing Sheets

PORTABLE BEER PONG DEVICE

BACKGROUND OF THE INVENTION

(1) Field of the Invention

The disclosure relates to beer pong devices and more particularly pertains to a new beer pong device for portably providing a unique setup configuration for the cups in beer pong.

(2) Description of Related Art Including Information Disclosed Under 37 CFR 1.97 and 1.98

The prior art relates to beer pong devices which provide various means of setting up cups for the play of beer pong, many of which are portable. Some of the devices in the prior art disclose apparatuses which attach to external structures while some of them setup independent from external structures. At least one device discloses a tiered apparatus for setting cups while another discloses an angled apparatus for a finger flicking football game. However, the prior art does not disclose a device which is collapsible for storage and transport, and which deploys such that there are two surfaces with slots for setting cups, one surface of which is at an angle and supported by a support member. It follows that the present invention discloses a device for setting cups for the play of beer pong in a unique setup not disclosed by the prior art.

BRIEF SUMMARY OF THE INVENTION

An embodiment of the disclosure meets the needs presented above by generally comprising a table with a tabletop and a detachable leg. A connecting panel is pivotably coupled to a front end of the tabletop, and a cup holding panel is pivotably coupled to the connecting panel opposite the tabletop. A support member is coupled to the cup holding panel opposite the connecting panel for supporting the cup holding panel in an angled position relative to a support surface. A plurality of main cup slots extends through the tabletop for receiving therethrough and holding a corresponding one of a plurality of cups. And a plurality of secondary cup slots extends through the cup holding panel for the same.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
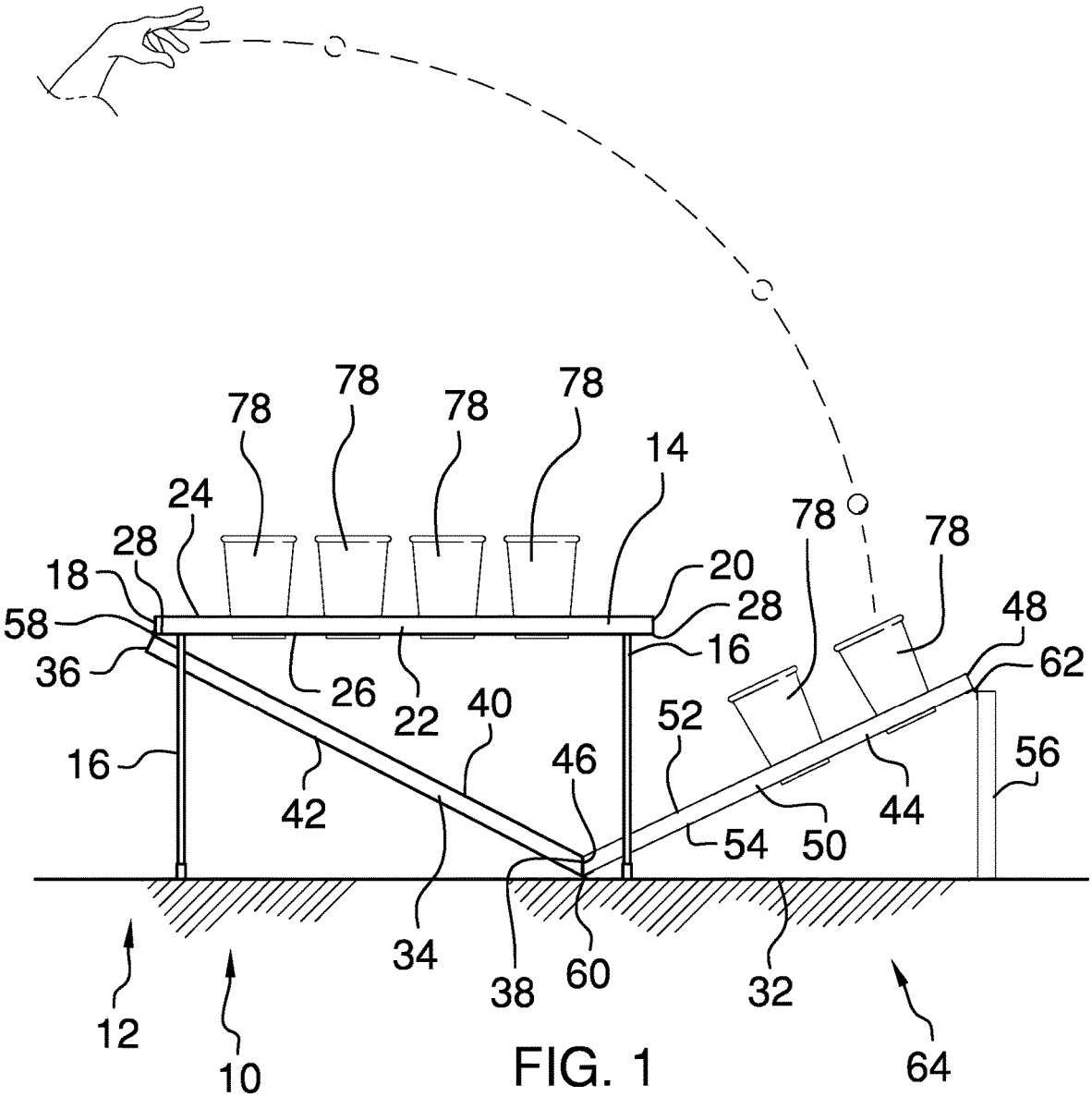
FIG. 1 is an in-use view of a portable beer pong device according to an embodiment of the disclosure.
Figure 2:
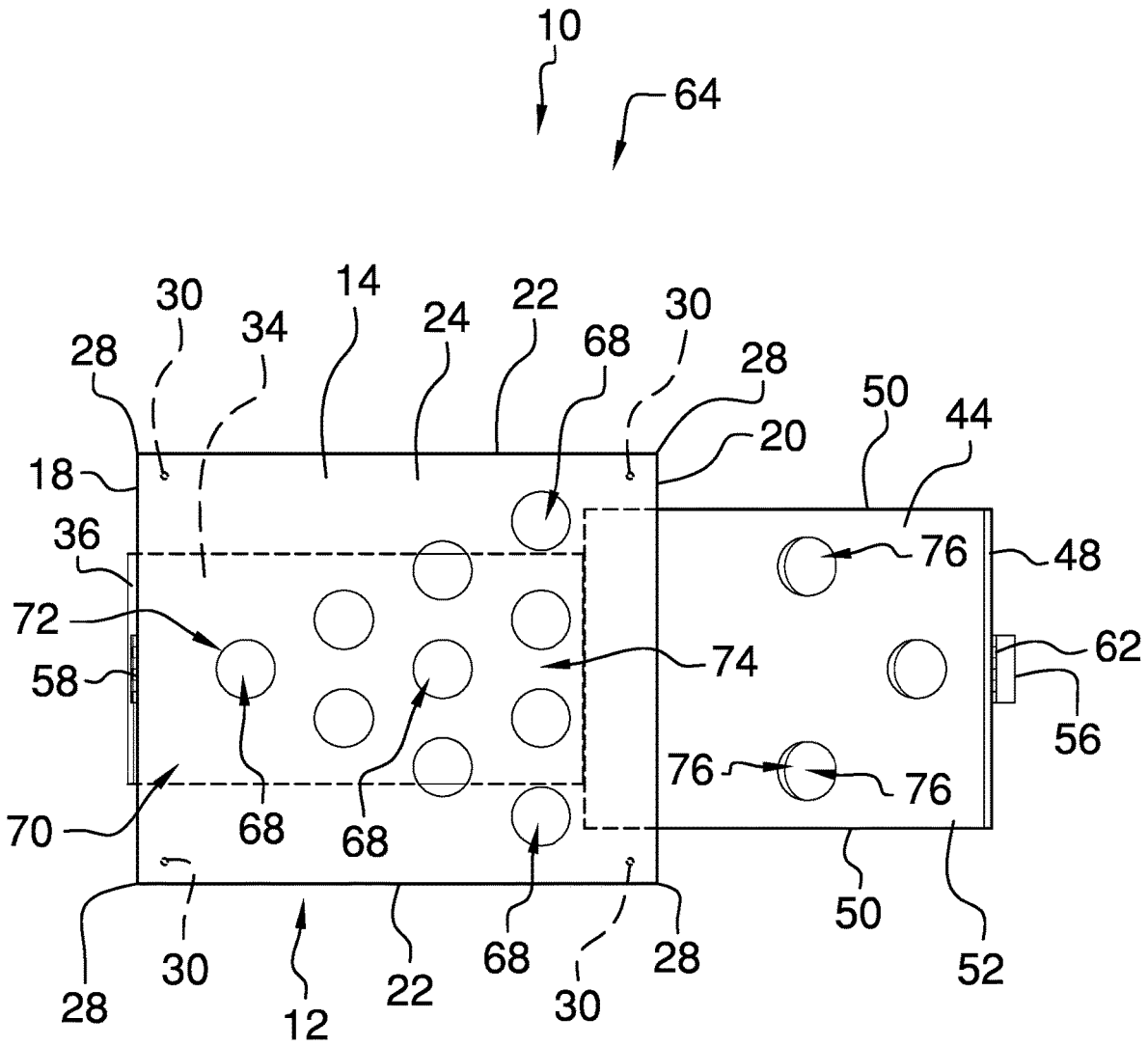
FIG. 2 is a top view of an embodiment of the disclosure.
Figure 3:
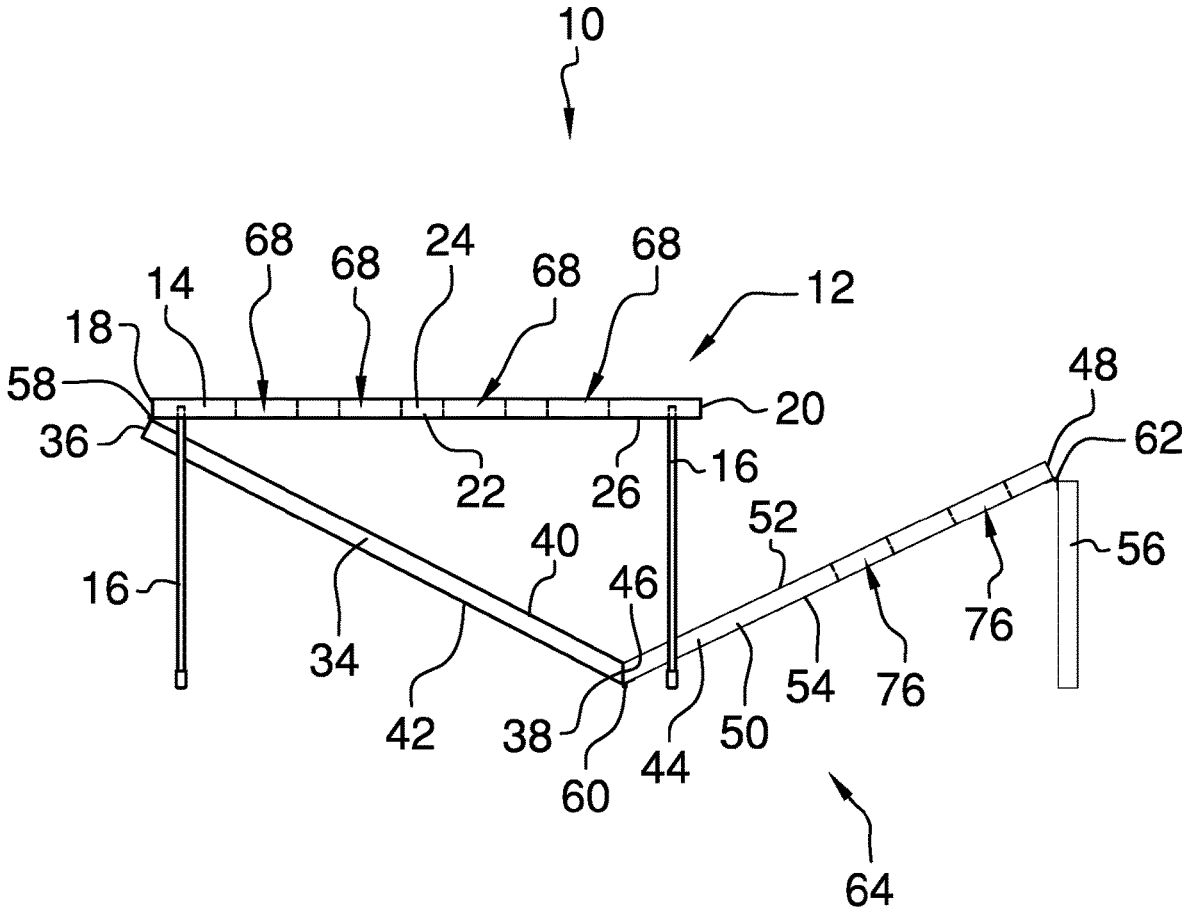
FIG. 3 is a side view of an embodiment of the disclosure.
Figure 4:
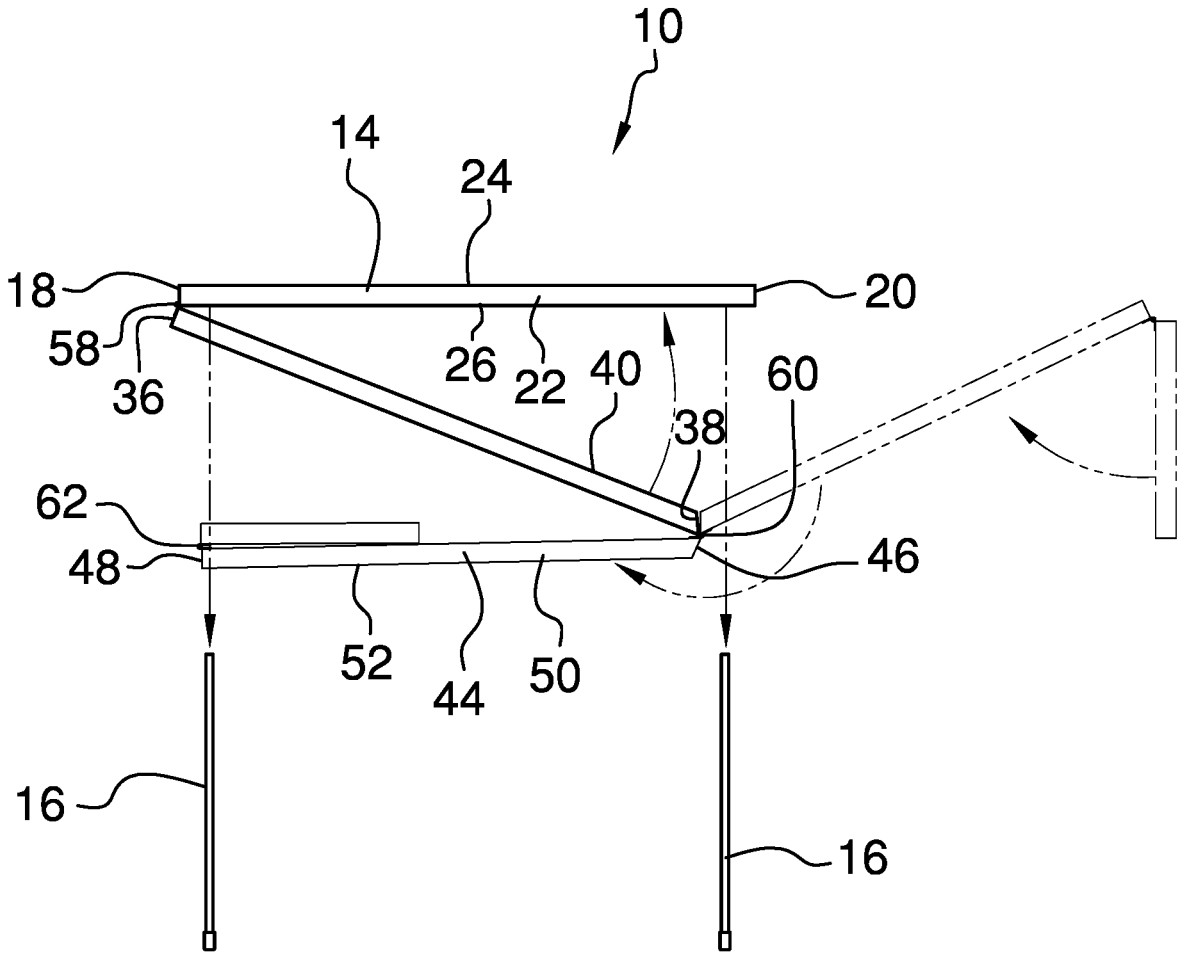
FIG. 4 is an exploded view of an embodiment of the disclosure.
Figure 5:
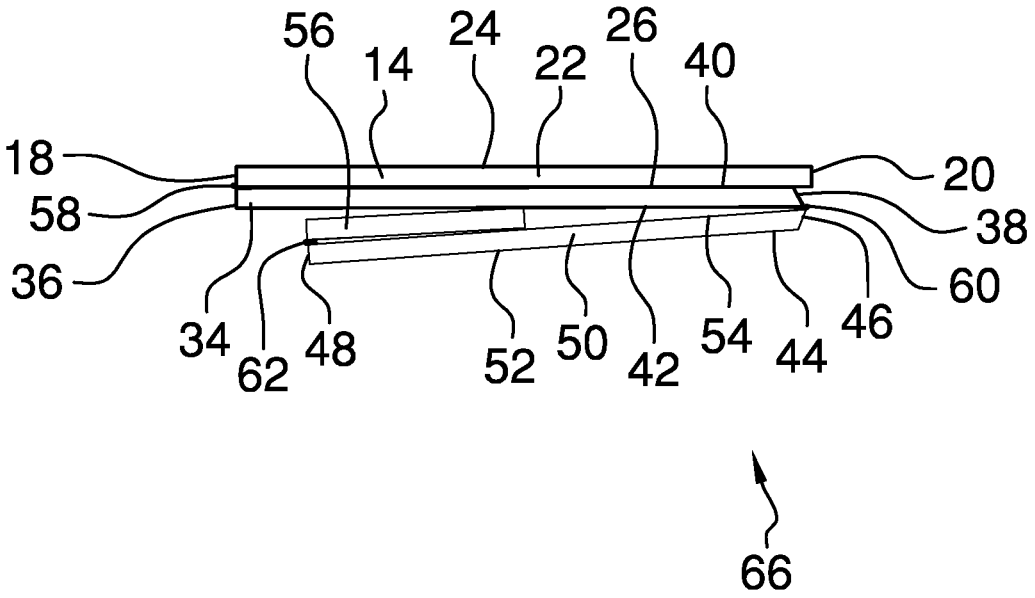
FIG. 5 is a detail view of an embodiment of the disclosure of the tabletop, the connecting panel, the cup holding panel, and the support member being positioned in the folded configuration.
Figure 6:
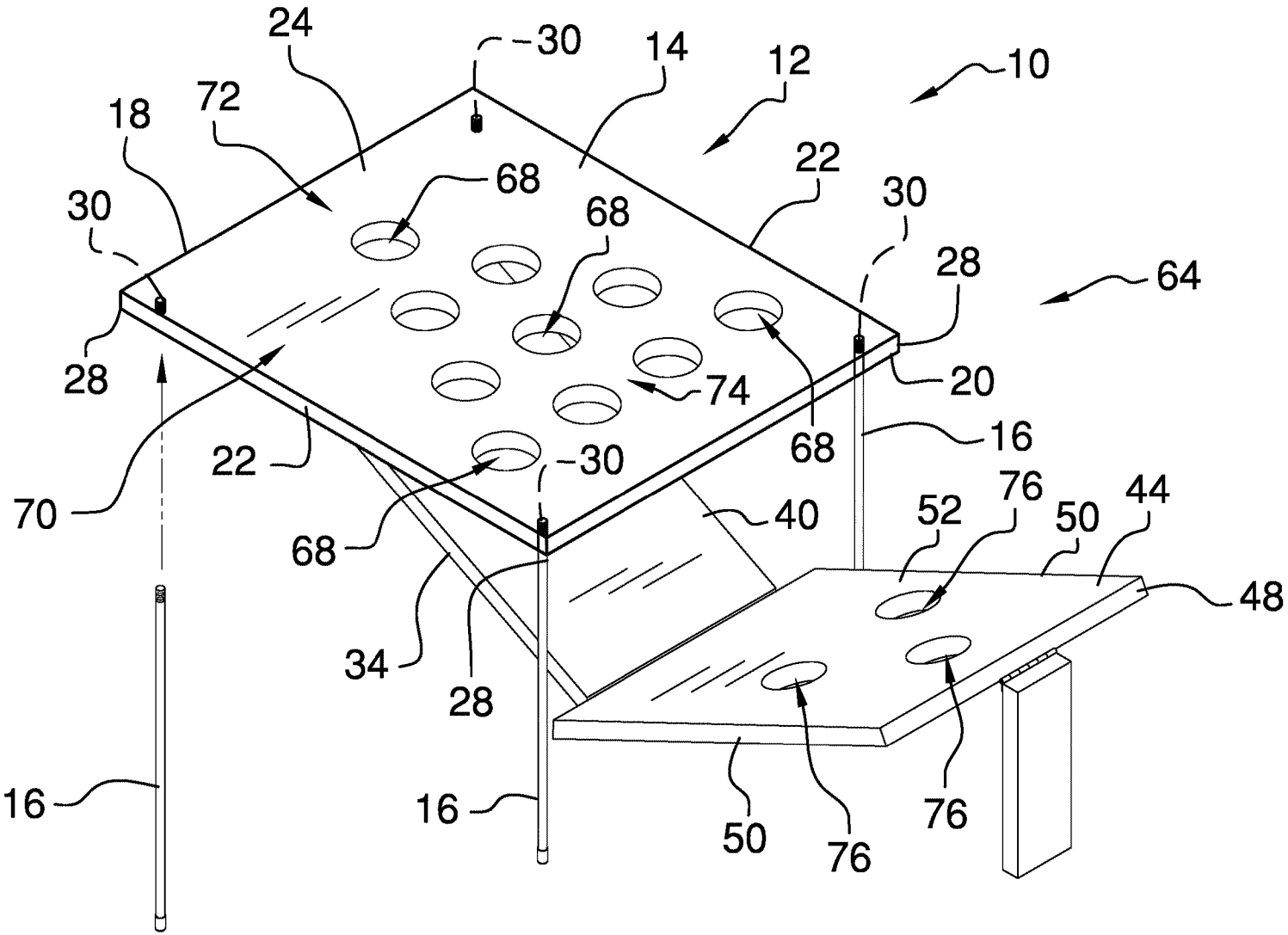
FIG. 6 is a perspective view of an embodiment of the disclosure.

With reference now to the drawings, and in particular to FIGS. 1 through 5 thereof, a new beer pong device embodying the principles and concepts of an embodiment of the disclosure and generally designated by the reference numeral 10 will be described.

As best illustrated in FIGS. 1 through 5, the portable beer pong device 10 generally comprises a table 12 having a tabletop 14 and a plurality of legs 16. The tabletop 14 has a front end 18 and a back end 20 and a pair of lateral sides 22 extending between the front end 18 of the tabletop 14 and the back end 20 of the tabletop 14. The tabletop 14 also has a top surface 24 and a bottom surface 26, each of the which extends between the front end 18 of the tabletop 14 and the back end 20 of the tabletop 14 and between the lateral sides 24 of the tabletop 14. Each of the top surface 24 of the tabletop 14 and the bottom surface 26 of the tabletop 14 is also square. Each leg 16 is detachably couplable to the bottom surface 26 of the tabletop 14 proximate an associated corner 28 of a plurality of corners 28 of the bottom surface 26 of the tabletop 14. Each leg 16 is insertable 12 into a corresponding leg hole 30 of a plurality of leg holes 30 and extends from the bottom surface 26 of the tabletop 14 when coupled to the tabletop 14. The leg holes 30 and legs 16 may be complementarily threaded. The plurality of legs 16 is configured for supporting the tabletop 14 on a support surface 32 when coupled to the tabletop 14.

A connecting panel 34 has a front side 36 and a back side 38. The connecting panel 34 also has a top surface 40 and a bottom surface 42, each of which extends between the front side 36 of the connecting panel 34 and the back side 38 of the connecting panel 34. The back side 38 of the connecting panel 34 is angled toward the front side 36 of the connecting panel 34 from the bottom surface 42 of the connecting panel 34 to the top surface 40 of the connecting panel 34. The front side 36 of the connecting panel 34 is pivotably coupled via a first hinge 58 to the front end 18 of the tabletop 14.

A cup holding panel 44 has a front side 46 and a back side 48 and a pair of lateral sides 50 extending between the front side 46 of the cup holding panel 44 and the back side 48 of the cup holding panel 44. The cup holding panel 44 has a top surface 52 and a bottom surface 54, each of which extends between the pair of lateral sides 50 of the cup holding panel 44 and between the front side 46 of the cup holding panel 44 and the back side 48 of the cup holding panel 44. The front side 46 of the cup holding panel 44 is angled toward the back side of the panel from the bottom surface 54 of the cup holding panel 44 to the top surface 52 of the cup holding panel 44. The front side 46 of the cup holding panel 44 is pivotably coupled via a second hinge 60 to the back side 38 of the connecting panel 34. A support member 56 is pivotably coupled via a third hinge 62 to the back end 20 of the cup holding panel 44.

Each of the table 12, the connecting panel 34, the cup holding panel 44, and the support member 56 is configurable in a deployed configuration 64 wherein the plurality of legs 16 is attached to the tabletop 14 and extend downward therefrom, the connecting panel 34 extends from the front end 18 of the tabletop 14 downward and toward the back end 20 of the tabletop 14, the cup holding panel 44 extends from the connecting panel 34 upward and away from the connecting panel 34, and the support member 56 extends downward. Each of the table 12, the connecting panel 34, the cup holding panel 44, and the support member 56 is configurable in a folded configuration 66 wherein the plurality of legs 16 is detached from the tabletop 14, the top surface 40 of the connecting panel 34 abuts the bottom surface 26 of the tabletop 14, and the support member 56 is positioned between and in abutment with the connecting panel 34 and the cup holding panel 44.

Ten circular main cup slots 68 extend through the tabletop 14. Each main cup slot 68 is configured for receiving an associated cup of a plurality of cups 78 therethrough and holding the associated cup. The main cup slots 68 are equally spaced and positioned to define a triangle 70. A vertex 72 of the triangle 70 facing the front end 18 of the tabletop 14, and a side 74 of the triangle 70 opposite the vertex 72 is parallel to the front end 18 of the tabletop 14. Three circular secondary cup slots 76 extend through the cup holding panel 44. Each secondary cup slot 76 is configured for receiving an associated cup 78 of the plurality of cups 78 therethrough and holding the associated cup. One of the secondary cup slots 76 is positioned proximate the back side 48 of the cup holding panel 44 and is centered between the pair of lateral sides 50 of the cup holding panel 44. A pair of the secondary cup slots 76 is positioned along a line parallel to the back side 48 of the cup holding panel 44 such that each of the pair of the plurality of secondary cup slots 76 is positioned proximate an associated lateral side 50 of the pair of lateral sides 50 of the cup holding panel 44.

In use, the device 10 may be setup in the deployed configuration 64 and set on a support surface 32 for use. While deployed on the support surface 32, the plurality of legs 16 support the tabletop 14, and the connecting panel 34 and the cup holding panel 44 hang below in a V-shape with the supporting member holding up the back side 48 of the cup holding panel 44, supporting it on the support surface 32. The plurality of cups 78 is placed in each of the main cup slots 68 and the secondary cup slots 76 so that a game of beer pong can be played. To store the device 10, the legs 16 are detached, and the tabletop 14, the connecting panel 34, the cup holding panel 44, and support member 56 are folded up.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable beer pong device comprising:

a table having a tabletop and a leg, said tabletop having a front end and a back end, said leg being detachably couplable to said tabletop;

a connecting panel having a front side and a back side, said front side of said connecting panel being pivotably coupled to said front end of said tabletop;

a cup holding panel having a front side and a back side, said front side of said cup holding panel being pivotably coupled to said back side of said connecting panel;

a support member being pivotably coupled to said back end of said cup holding panel, each of said table, said connecting panel, said cup holding panel, and said support member being configurable in a deployed configuration wherein said leg is attached to said tabletop, said connecting panel extends from said front end of said tabletop downward and toward said back end of said tabletop, said cup holding panel extends from said connecting panel upward and away from said connecting panel, and said support member extends downward, each of said table, said connecting panel, said cup holding panel, and said support member being configurable in a folded configuration wherein said leg is detached from said tabletop, said connecting panel abuts said tabletop, and said support member is positioned between and in abutment with said connecting panel and said cup holding panel;

a plurality of main cup slots extending through said tabletop; and a plurality of secondary cup slots extending through said cup holding panel.

2. The device of claim 1, further comprising said tabletop having a front end and a back end, said tabletop having a pair of lateral sides extending between said front end of said tabletop and said back end of said tabletop, said tabletop having a top surface and a bottom surface, each of said top surface of said tabletop and said bottom surface of said tabletop extending between said front end of said tabletop and said back end of said tabletop and between said lateral sides of said tabletop.

3. The device of claim 2, further comprising said plurality of main cup slots being equally spaced and positioned to define a triangle, a vertex of said triangle facing said front end of said tabletop, a side of said triangle opposite said vertex being parallel to said front end of said tabletop.

4. The device of claim 3, further comprising said plurality of main cup slots being ten main cup slots.

5. The device of claim 2, further comprising said connecting panel having a top surface and a bottom surface, each of said top surface of said connecting panel and said bottom surface of said connecting panel extending between said front side of said connecting panel and said back side of said connecting panel, said top surface of said connecting panel abutting said bottom surface of said tabletop in said deployed configuration.

6. The device of claim 1, further comprising:

said connecting panel having a top surface and a bottom surface, each of said top surface of said connecting panel and said bottom surface of said connecting panel extending between said front side of said connecting panel and said back side of said connecting panel, said back side of said connecting panel being angled toward said front side of said connecting panel from said bottom surface of said connecting panel to said top surface of said connecting panel, said front side of said connecting panel being pivotably coupled via a first hinge to said front end of said tabletop; and said cup holding panel having a pair of lateral sides extending between said front side of said cup holding panel and said back side of said cup holding panel, said cup holding panel having a top surface and a bottom surface, each of said top surface of said cup holding panel and said bottom surface of said cup holding panel extending between said pair of lateral sides of said cup holding panel and between said front side of said cup holding panel and said back side of said cup holding panel, said front side of said cup holding panel being angled toward said back side of said panel from said bottom surface of said cup holding panel to said top surface of said cup holding panel, said front side of said cup holding panel being pivotably coupled via a second hinge to said back side of said connecting panel.

7. The device of claim 1, further comprising:

said cup holding panel having a pair of lateral sides extending between said front side of said cup holding panel and said back side of said cup holding panel, said cup holding panel having a top surface and a bottom surface, each of said top surface of said cup holding panel and said bottom surface of said cup holding panel extending between said pair of lateral sides of said cup holding panel and between said front side of said cup holding panel and said back side of said cup holding panel; and said plurality of secondary cup slots being three secondary cup slots, one of said plurality of secondary cup slots being positioned proximate said back side of said cup holding panel and centered between said pair of lateral sides of said cup holding panel, a pair of said plurality of secondary cup slots being positioned along a line parallel to said back side of said cup holding panel such that each of said pair of said plurality of secondary cup slots is positioned proximate an associated lateral side of said pair of lateral sides of said cup holding panel.

8. The device of claim 2, further comprising said leg being one of a plurality of legs, each said leg being detachably couplable to said bottom surface of said tabletop proximate an associated corner of a plurality of corners of said bottom surface of said tabletop, each said leg being insertable into a corresponding leg hole of a plurality of leg holes, each said leg extending from said bottom surface of said tabletop when coupled to said tabletop.

9. The device of claim 8, further comprising each said leg hole being internally threaded, each said leg being externally threaded and complementary in shape to said corresponding leg hole.

10. The device of claim 1, further comprising each said main cup slot being circular, each said secondary cup slot being circular.

11. A portable beer pong device comprising:

a table having a tabletop and a plurality of legs, said tabletop having a front end and a back end, said tabletop having a pair of lateral sides extending between said front end of said tabletop and said back end of said tabletop, said tabletop having a top surface and a bottom surface, each of said top surface of said tabletop and said bottom surface of said tabletop extending between said front end of said tabletop and said back end of said tabletop and between said lateral sides of said tabletop, each of said top surface of said tabletop and said bottom surface of said tabletop being square, each said leg being detachably couplable to said bottom surface of said tabletop proximate an associated corner of a plurality of corners of said bottom surface of said tabletop, each said leg being insertable into a corresponding leg hole of a plurality of leg holes, each said leg extending from said bottom surface of said tabletop when coupled to said tabletop, said plurality of legs being configured for supporting said tabletop on a support surface when coupled to said tabletop;

a connecting panel having a front side and a back side, said connecting panel having a top surface and a bottom surface, each of said top surface of said connecting panel and said bottom surface of said connecting panel extending between said front side of said connecting panel and said back side of said connecting panel, said back side of said connecting panel being angled toward said front side of said connecting panel from said bottom surface of said connecting panel to said top surface of said connecting panel, said front side of said connecting panel being pivotably coupled via a first hinge to said front end of said tabletop;

a cup holding panel having a front side and a back side, said cup holding panel having a pair of lateral sides extending between said front side of said cup holding panel and said back side of said cup holding panel, said cup holding panel having a top surface and a bottom surface, each of said top surface of said cup holding panel and said bottom surface of said cup holding panel extending between said pair of lateral sides of said cup holding panel and between said front side of said cup holding panel and said back side of said cup holding panel, said front side of said cup holding panel being angled toward said back side of said panel from said bottom surface of said cup holding panel to said top surface of said cup holding panel, said front side of said cup holding panel being pivotably coupled via a second hinge to said back side of said connecting panel;

a support member being pivotably coupled via a third hinge to said back end of said cup holding panel, each of said table, said connecting panel, said cup holding panel, and said support member being configurable in a deployed configuration wherein said plurality of legs is attached to said tabletop and extend downward therefrom, said connecting panel extends from said front end of said tabletop downward and toward said back end of said tabletop, said cup holding panel extends from said connecting panel upward and away from said connecting panel, and said support member extends downward, each of said table, said connecting panel, said cup holding panel, and said support member being configurable in a folded configuration wherein said plurality of legs is detached from said tabletop, said top surface of said connecting panel abuts said bottom surface of said tabletop, and said support member is positioned between and in abutment with said connecting panel and said cup holding panel;

a plurality of main cup slots extending through said tabletop, each said main cup slot being configured for receiving an associated cup of a plurality of cups therethrough and holding the associated cup, each said main cup slot being circular, said plurality of main cup slots being equally spaced and positioned to define a triangle, a vertex of said triangle facing said front end of said tabletop, a side of said triangle opposite said vertex being parallel to said front end of said tabletop, said plurality of main cup slots being ten main cup slots; and a plurality of secondary cup slots extending through said cup holding panel, each said secondary cup slot being configured for receiving an associated cup of the plurality of cups therethrough and holding the associated cup, each said secondary cup slot being circular, said plurality of secondary cup slots being three secondary cup slots, one of said plurality of secondary cup slots being positioned proximate said back side of said cup holding panel and centered between said pair of lateral sides of said cup holding panel, a pair of said plurality of secondary cup slots being positioned along a line parallel to said back side of said cup holding panel such that each of said pair of said plurality of secondary cup slots is positioned proximate an associated lateral side of said pair of lateral sides of said cup holding panel.

12. The device of claim 11, further comprising each said leg hole being internally threaded, each said leg being externally threaded and complementary in shape to said corresponding leg hole.

* * * * *